United States Patent [19]

Swanson

[11] Patent Number: 4,669,127

[45] Date of Patent: Jun. 2, 1987

[54] PACK VEST

[76] Inventor: Richard A. Swanson, 3902 NE. 157th Pl., Seattle, Wash. 98155

[21] Appl. No.: 819,385

[22] Filed: Jan. 16, 1986

[51] Int. Cl.[4] ..... A41D 1/02; A41D 27/14

[52] U.S. Cl. ..... 2/46; 2/94; 2/102; 2/247

[58] Field of Search ..... 2/94, 102, 46, 247

[56] References Cited

U.S. PATENT DOCUMENTS

| | | | |
|---|---|---|---|
| 3,130,416 | 4/1964 | Mitchell et al. | 2/94 X |
| 3,529,307 | 9/1970 | Belson et al. | 2/94 |
| 3,708,799 | 1/1973 | Smithdeal | 2/46 |

*Primary Examiner*—H. Hampton Hunter
*Attorney, Agent, or Firm*—Garrison & Stratton

[57] ABSTRACT

A utility garment for load portage in the shape of a vest containing load carrying compartments on the back and front flaps of the vest. The vest closes at the front, and a waist belt attached to back and front flaps through tie down loops holds the loaded vest to the wearer to prevent shifting of loads and upward creeping of the front flaps and to distribute a portion of the read load directly to the wearer's hip region. A stowable water repellent seat protector hangs from the bottom of the back of the pack for the packer to sit upon.

12 Claims, 8 Drawing Figures

PACK VEST

FIELD OF THE INVENTION

This present invention generally relates to the art of garments, especially coats and vests and, more particularly, is concerned with a vest structure having features of a pack, and further having weight distribution features to permit the wearer to carry a substantial load without undue discomfort.

BACKGROUND INFORMATION

The typical pack or backpack, sometimes called a knapsack or rucksack, is a fabric bag or case designed for carrying equipment or supplies on the back. It usually contains one or more fabric compartments and may or may not be associated with a metal frame with straps designed to hold the pack upon the back of the user.

Typically, the weight of the pack is transferred to the backpacker by straps which go above, and then in front of, the shoulders and are then connected at or near the front bottom panel of the backpack. The weight, thus concentrated on the back and shoulders requires a backpacker to bend forward to compensate for the unnatural disbribution of weight. The concentration of pressure at the shoulders caused by the weight usually produces pressure points often causing soreness in that region of the body.

In addition, because of the position of the pack on the user's back, access to the contents of a pack while the pack is in place is difficult. In order to gain access to the pack, the pack usually has to be taken off or another person is required to gain access to the pack when on the backpacker.

The distance the weight in a pack is from the body determines the stress produced by the weight on the body since the farther the weight is carried from the body, the more the body must strain or compensate by bending in the opposite direction. The typical pack provides little or no protection from the elements.

Hunting and fishing vests are known with load carrying fabric compartments in the front breast flaps and in the lower back part. The typical load carrying vest, however, bears a much smaller capacity for loads than a backpack. A back loaded vest will creep down the back of the user thereby pulling the front breast flaps upward making an unsatisfactory load carrying device.

Accordingly, an object of my invention is to provide a vest with cargo carrying features having a waist level belt and buckle means in order to keep the vest from creeping and to constrain the weight close to the body.

Another object of my invention is to provide a vest with cargo carrying features having a self-contained backside protector which will protect the backside of the user whenever seated.

Additional objects of my invention will be obvious from a reading of the specification and the drawings.

A further object of my invention is to provide a load carrying vest which balances the load on the front and back of the user and which, by its construction, provides enhanced weight distribution to the shoulders, back, and waist of the user when loaded with cargo.

SUMMARY OF THE INVENTION

My pack vest features a vest shaped article of clothing with one or more compartments sewn into the back portions and the front breast flaps of the vest. When worn, the breast flaps close around the front of the user and are zippered or otherwise fastened together in well known fashion. A waist belt, laced through tie-down loops sewn along the bottom of the front and back of the pack vest, when buckled around the user, restricts the waist opening of the vest to the waist of the user keeping the weight of the loaded pack vest strapped close to the body to prevent the weight from creeping. The waist belt also provides weight distribution features so that a portion of the weight is transferred directly to the user's waist and hip region. The waist belt also keeps the weight from jogging or bouncing on the user when the user walks. With the weight closer to the body, the user need not lean as much in order to compensate for a weight extended from the body. Loading cargo into the front compartments helps to balance the load and ease its effect on the user.

The belt is length adjusted by use of end slots on a two-part, compound buckle which can be snapped opened or closed using a male-female locking mechanism. The ends of the belt are laced through slots to the desired length and then outwardly folded upon themselves. The surfaces of the belt are rough surfaced so that when crimps are used to pin the folded portion of the belt against the unfolded portion near the slots, slippage of the belt is prevented. The outwardly folded portions of the ends keep the buckle centered by preventing the buckle from creeping into a loop.

While my pack vest herein described is sleeveless, it is obvious that either permanent or removable sleeves attached to the arm openings would be considered within the concept of my invention. In addition, a soft material with insulating properties can be applied to the inner or outer surface of the pack vest to make the pack vest more comfortable and adapted for use in cold weather.

DESCRIPTION OF THE PREFERRED EMBODIMENT

Figure 1:
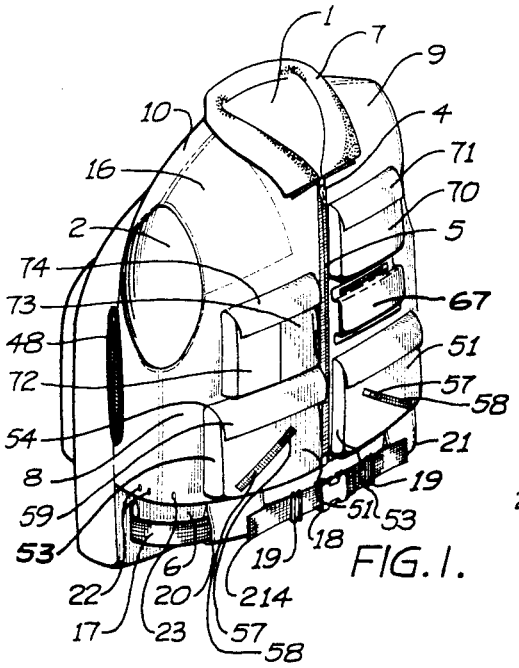
FIG. 1 is a perspective view of the pack vest from the front.
Figure 2:
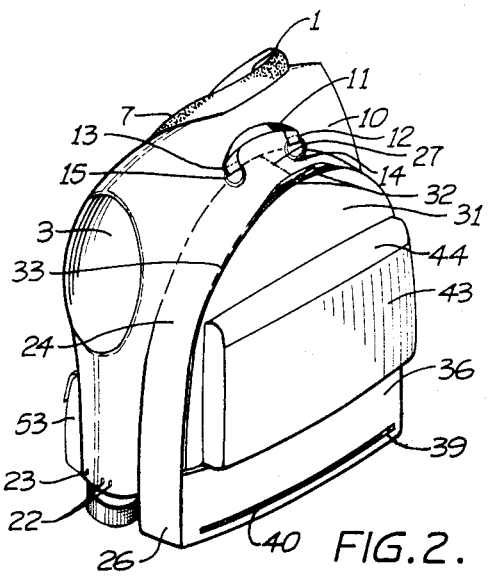
FIG. 2 is a perspective view of the pack vest from the rear.
Figure 4:
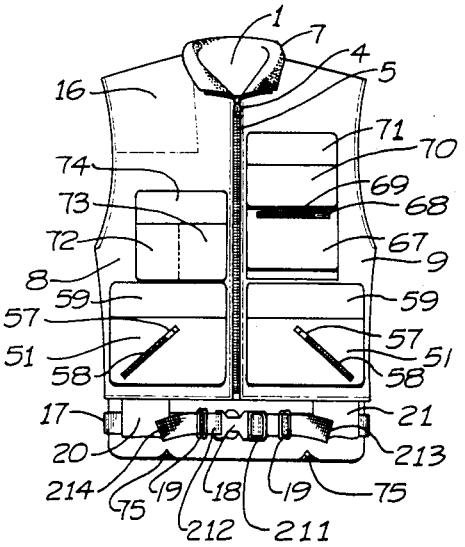
FIG. 4 is a front elevational view of the pack vest.
Figure 3:
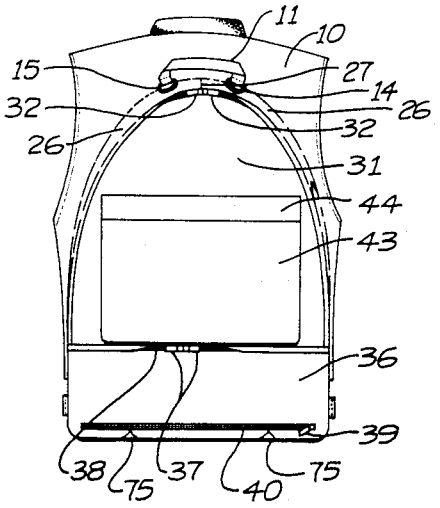
FIG. 3 is a rear elevational view of the pack vest.

The pack vest is constructed of a pliable flexible sheet material which can be sewn, such as rip stop nylon; heavy canvas or the like. I prefer a rip stop type nylon for the construction of this pack vest because of its durability, ease of fabrication, longevity, wearability, its availability in various colors and light weight. While the color selected for the preferred embodiment is red, since red is the universal protector color for hunters, it is obvious that other useful colors may be selected according to the use of the pack vest. For example, camouflage green may be a more useful color for pack vests to be carried into warfare or for guerrilla activities, or bright yellow where long distance visibility may be useful.

Although the pack vest is shown in the drawings with a certain shape, because of its construction, the pack vest would not stand up as shown in the figures when not worn by the user and the compartments would not be expanded when empty.

Referring now to the drawings, it will be seen that the pack vest has a neck opening 1 with a right 2 and left 3 arm opening. Once the pack vest is in place on the user, it can be closed with a zipper runner 4 pulled along zipper tracks 5 from the waist opening 6 to any point up to the neck opening 1. A collar 7 is fitted around the neck opening 1. The pack vest has a right and left breast flap 8 and 9 respectively and back piece 10. The back piece 10 is shaped into an essentially rectangular form and when joined to the breast flaps 8 and 9 will be slightly longer than the length of the breast flaps. As will be described further, the back piece 10 also serves as one wall of a large cargo compartment and other structural features of this invention.

A lifting and hanging strap 11 is integrally attached symmetrically across the center of the back piece near the neck opening 1 to conveniently grasp or carry the pack vest when not on the user's back or for use in hanging the pack vest up when not in use. Because the pack vest is designed to carry a substantial load, the ends 12 and 13 of the hanging strap 11 are securely sewn into the fabric. "D" shaped metal rings 14 and 15 are attached by wrapping the ends of the hanging strap about the straight section of the "D" before sewing the attachment ends into the back piece 11. The "D" shaped metal rings 14 and 15 provide convenient tie-downs near the top of the rear portion of the pack vest. Articles of clothing (not shown) such as rain gear, tents or bed rolls can be secured onto these rings. Bulky items such as a sleeping bag, sleeping pads or fishing rods may also be conveniently attached to rings 14 and 15.

A shoulder pad 16 is shown inserted into a pocket sewn to the upper part of the right breast flap to provide a means of cushioning and distributing the recoil force of a rifle. While the should pad 16 is shown to be on the right breast flap, it could also be sewn into the identical area of the left breast flap in order to provide the same function to a left handed user.

Figure 8:
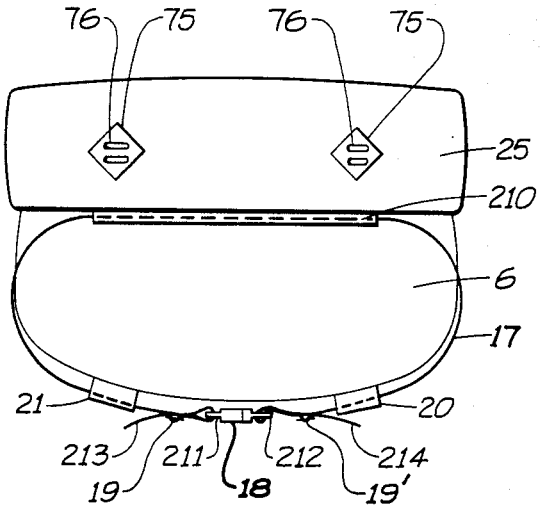
FIG. 8 is a perspective view of the pack vest from the bottom.

The distribution of weight and control of the pack vest in use is provided by structural features best seen in FIGS. 1 and 8. A waist belt 17 is laced through waist level tie-down loops 20 and 21, attached to front flaps 8 and 9 respectively, and through a similar tie-down loop 210 (FIG. 8) attached at the bottom of the back piece 10. The belt 17 has a rough textured surface and its ends are laced through slots 211 and 212 at the ends of a buckle 18 and folded outwardly. Crimps 19 and 19' are used to adjustably secure the folded portion of the belt to the unfolded portion of the belt near the slots 211 and 212. The meshing of the rough surfaces of the belt surfaces helps prevent slippage of the belt. The buckle 18 of a well known construction can be snapped open or closed by a male-female locking means (not shown) located in the buckle. The end portion 213, 214 of the belt 17 extend outwardly from belt 17 and prevent the buckle from creeping within the waist level tie-down loops 20 and 21. The interengagement and locking structure of the belt 17 and loops 20 and 21 permit lengthwise adjustment of the belt but prevent the loaded pack vest from shifting position on the wearer.

Several male snap fasteners 22 are riveted along a horizontal line near the bottom of the back piece 10 along the lower side area of the pack vest for engagement with a matching female snap fastener 23 riveted near the bottom of breast flaps 8 and 9. By selecting the appropriate male snap fastener to be snapped to the female snap fastener 23, the size of the waist opening 6 can be adjusted to near the size of the user.

A large compartment, generally shown as 24, is formed by securely attaching appropriately shaped cloth segments to the back piece 10. A bottom strip 25, several inches wide and long enough to be sewn along the entire bottom edge of the back piece forms the bottom of the large compartment. Two side strips 26 several inches wide are sewn to the back piece in a semi-circular fashion from the ends of the bottom strip upwardly to be joined at the center of the back piece at seam line 27 near the neck opening. In my preferred embodiment, a large compartment is further divided into three tiered, individual compartments by the use of an upper and lower divider strip shown in FIG. 6 by dashed lines 28, 29 respectively, both essentially the same size and shape as the bottom strip and sewn into the back piece and side strips. The upper compartment 30 is closable by use of a semi-circular shaped upper compartment flap 31 permanently sewn along the divider strip 28. Two zipper runners 32 open or close the upper compartment when run on two matching zipper tracks 33 sewn along the edge of the upper compartment flap and corresponding edge of the side strips. The middle compartment 34 and lower compartment 35 are enclosed by a single covering 36 sewn to the edge of the upper divider strip 28 and lower edge of the upper compartment flap, the edges of the lower portions of the side strips and the edge of the bottom strip 29. Access to the middle compartment is provided by a horizontal entrance located at the top of the middle compartment featuring two zipper runners 37 on zipper tracks 38 sewn into both edges of the entrance. Access to the lower compartment 35 is provided by a horizontal entrance located at the bottom of the lower compartment using a zipper runner 39 on matching zipper tracks 40. Other well known closure mechanisms can, of course, be substituted.

Figure 5:
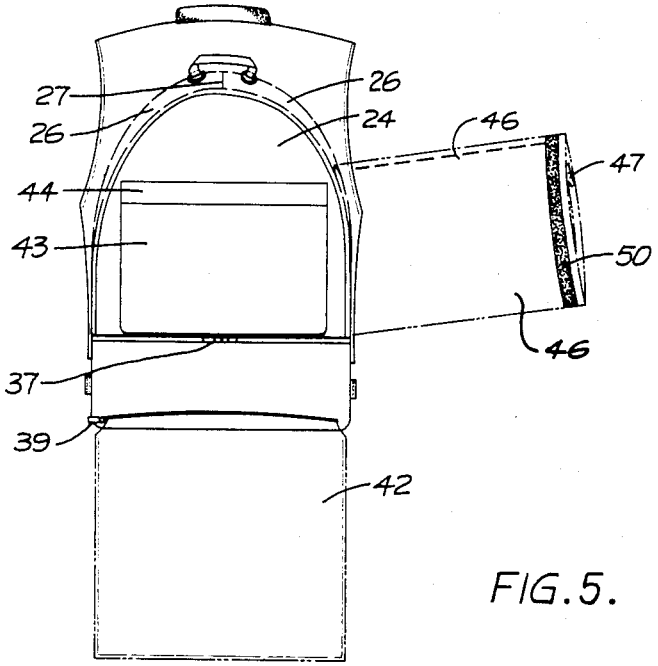
FIG. 5 is a rear elevational view of the pack vest indicating the backside protector and removable game bag partially extended from the pack vest.
Figure 6:
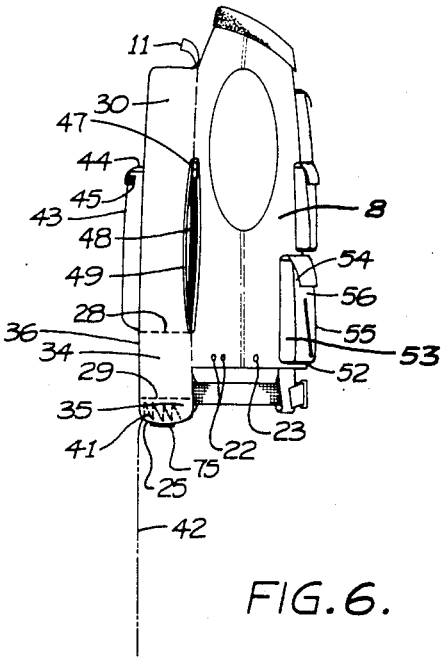
FIG. 6 shows a side elevational view of a pack vest with the seat protector in the extended position and in the folded position.
Figure 7:
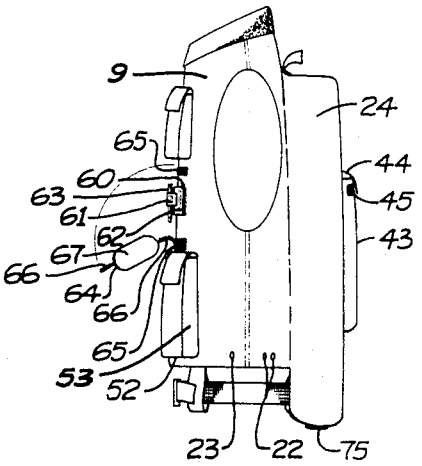
FIG. 7 is a side elevational view of the pack vest indicating the opening of the shell storage cover located on the left breast flap of the pack vest.

A rectangular, water resistant seat protector of flexible material 42 is permanently sewn into the lower compartment 35 along one of its edges and is normally rolled or folded therein as shown at numeral 41 in FIG. 6. When the user wishes to sit on a wet object, the lower compartment can be opened and the protector 42 can be extended through the opening as shown in the extended position in FIG. 5 and 6. The extended seat protector 42 prevents the user's backside from moisture and soil when seated thereupon with the pack vest in place.

A map compartment generally shown as 43 is provided by sewing the bottom edge and side edges of an essentially rectangular piece of material onto the upper compartment flap 31. A map compartment cover 44 is sewn onto the upper compartment flap 31 to overextend the opening of the map compartment. The map compartment cover 44 may be sealed by means of hook and loop closure materials 45 or other suitable closure means.

A removable game pocket 46 is made by folding an essentially square water repellent fabric in two and sewing the doubled edge and one of the sides together along stitch line 46'. The remaining side, which now forms an opening, is provided with a zipper closure 47. The removable game pocket is inserted into a side opening 48 located at the seam on the right-hand side of the upper compartment. The inside edges of the side opening are provided with matching hook and loop closure materials 49. The outside edges of the zippered end of the game pocket are also provided with matching hook and loop closure materials 50 so that the game pocket may be inserted into the side opening 48 and closed thereto by means of the hook and loop closure materials 49 and 50. Of course, when the game pocket is removed, the side opening can be closed with the matching hook and loop closure materials 49. The hook and loop closure materials on the game pocket and the side pocket are oriented in such a way that the game pocket fastens inside the side opening when it is inserted into the side opening with the sewn edge of the game pocket oriented upwardly. In this way, the folded edge is oriented downwardly thus preventing blood or other fluids from any game which may be stored within the game pocket 46 from seeping into the upper compartment. The game pocket 46 is also entirely removable and may be used separately from the pack vest and laundered independently from the pack vest. FIG. 5 demonstrates the game pocket 46 partially removed from the side opening 48.

Attached to the bottom part of each breast flap is a carryall dual compartment pocket 51, each having a bottom strip 52 sewn along its edge to near the bottom of each breast flap, two side strips 53 joined to the ends of the bottom strip and vertically joined to the breast flap in such a way that the top end of each side strip is pinched toward and sewn to the breast flaps 8 and 9 at the top edge 54. An inner septum (not shown) divides each pocket into two parts, accessable from top entrance flap 59 and the other through a diagonal opening through the outer pocket cover 51. The diagonal opening is closed by zipper runner 57 and matching zipper tracks 58. Entrance flap 59 is sewn into each breast flap to overextend the opening of the upwardly oriented inner compartment, and is secured to the top portion of the outer pocket covery by means of hook and loop closure materials.

Attachable to the left breast flap above the carryall dual compartment pocket 51 is an ammunition holder 60 made by sewing vertically oriented loops of elastic band 61 of about ¾" wide horizontally along a rectangular flat base 62. The loops grasp rounds of ammunition 63. The back of the base has a hook and loop closure material with matching hook and loop material sewn onto the left breast flap above the dual pockets so that the ammunition holder 60 can be attached thereto or removed at will. A rectangular ammunition holder cover 64 is also removably attached over the ammunition holder onto the left breast flap by use of hook and loop closure material strips 65 on the breast flap and on the ammunition holder cover 66 placed horizontally above and below the ammunition holder 60. The cover 64 is made by folding a rectangular strip into an almost square shape and sewing the edges together forming an enclosed holder pocket 67. Access to the interior of the holder pocket 67 is through a horizontal opening with zipper runner 68 and zipper tracks 69. Obviously, any general or special purpose device, such as photographic apparatus holder, fishing apparatus holder, etc., may be substituted for the ammunition holder 60.

A pouch pocket 70 is attached to the left breast flap above the ammunition holder 60. The pouch pocket 70 is made by sewing an almost square piece of material along the bottom and side edges into the left breast flap. The top edge of the material is folded about an elastic cord (not shown) and sewn together to form a tunnel about the elastic cord. The ends of the elastic cord are sewn to the top of each side edge and left breast flap such that the upward opening of the pouch pocket is partially closed with the elastic cord. A pouch pocket cover 71, sewn into the left breast flap overextends the opening of the pouch pocket and can be sealed to the pack pocket by means of hook and loop closure materials. The pouch pocket 70 is well adapted to receive a miniature camera or binocular.

A tri-compartment pocket 72, made by sewing the bottom and side edges of an essentially square shaped material to the right breast flap in the area above the carryall dual compartment pocket, two vertically oriented septa (not shown) are sewn from the midline 73 of the material to a corresponding line (not shown) behind the tri-compartments (not shown).

A tri-compartment cover 74 is attached to the breast flap to overextend the three vertical compartment openings and is secured to the top portion of the tri-compartment pocket's outside by hook and loop closure materials (not shown).

Two parallelogram shaped strap receiving leather patches 75 are sewn to the bottom of the large compartment on the back piece for attachment of a rolled-up sleeping bag, sleeping pad, tent or the like, using flat fabric strips or cording laced through aperture 76 in the patches. Such patches, which are convenient means to attach lightweight but bulky objects to the pack vest may be provided at other strategic locations for convenience.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the legitimate and valid scope of the appended claims, appropriately interpreted in accordance with the doctrine of equivalents.

I claim:

1. A utility pack vest type garment constructed of flexible sheet material having a neck opening, waist opening, two arm openings, two breast flaps forming the front, and a back piece forming the rear, comprising:

a front closure means for joining said two breast flaps at an adjustable distance from the waist opening to the neck opening;

one or more pack compartments integrally attached into said back piece and said breast flaps;

and a waist encircling belt means interengaging said back piece and each of said breast flaps, whereby all pack compartment loads are constrained close to the wearer's body, (b) a portion of the weight of a rear pack component load is transferred directly to the wearer's waist and hip region, (c) said breast flaps are prevented from creeping upward under the load weighted influence of said rear pack compartment, and (d) said garment is secured from shifting when loaded.

2. The garment of claim 1 wherein said waist encircling belt means comprises:

a plurality of tie-down loops spaced along the waist opening;

a belt with ends laced through said tie-down loops; and means to adjustably secure said belt around the waist of the user.

3. The garment of claim 2 wherein said means to adjustably secure said belt around the waist of the user further comprises:

a rough texture on the surface of said belt;

a two part compound buckle joined together with a male/female locking means at the center;

a slot on each of the ends of said buckle through which respectively corresponding ends of said belt are laced and then outwardly folded back upon themselves so that the rough texture on the surface of the folded portion of said belt end meshes into the rough texture on the corresponding waist encircling portion of said belt;

crimping means for each of said belt ends for releasably constraining said folded portions of said belt ends into meshed interengagement with said corresponding rough textured waist encircling belt portion, whereby said buckle is prevented by said crimping means and said folded belt ends from creeping into said tie down loops.

4. The garment of claim 1 adapted for use in cold weather further comprising:

a collar strip attached to an edge of said neck opening;

a soft material with temperature insulating properties applied to one or more surfaces of said back piece, breast flaps, and collar strip.

5. The garment of claim 4 further comprising sleeves attached to said arm openings.

6. A garment constructed of flexible material having a neck opening, waist opening, two arm opening, two breast flaps forming the front, and a back piece forming the rear, comprising:

a front closure means for joining said two breast flaps at an adjustable distance from the waist opening to the neck opening;

at least one rear pack compartment integrally attached to said back piece;

tie-down loops positioned at the bottom of said breast flaps and said back piece;

a waist encircling belt means laced through said tie-down loops;

a means to adjustably secure said belt means around the waist of the user whereby a portion of the weight in said rear pack compartment is partially supported at the users waist while said breast flaps are prevented from creeping upwardly along the front of the user.

7. The garment of claim 6 wherein said front closure means is in the form of a zipper type closure.

8. The garment of claim 6 adapted for use in cold weather further comprising:

a collar strip attached along an edge of said neck opening;

a pair of long sleeves attached to said arm opening;

a soft material with temperature insulating properties applied to the inside of said garment.

9. The garment of claim 6 wherein said means to adjustably secure said belt around the waist of the wearer comprises:

a rough texture on the surfaces of said belt;

a two part compound buckle joined together with a male/female locking means at the center;

a slot on each of the ends of said buckle through which respectively corresponding ends of said belt are laced and then folded outwardly back upon themselves such that the rough texture on the surface of the folded portion of said belt end meshes into the rough texture on the corresponding waist encircling portion of said belt;

crimping means for each of said belt ends for releasably constraining said folded portions of said belt ends into meshed interengagement with said corresponding rough textured waist encircling belt portion, whereby said buckle is prevented by said crimping means and said folded belt ends from creeping into said tie down loops.

10. The garment of claim 6 wherein one or more cargo carrying compartments are positioned on said breast flaps and on said back piece.

11. In a pack vest constructed of flexible material and having a neck opening, waist opening, two breast flaps forming the front, a back piece forming the rear, a front closure means for joining the two breast flaps at an adjustable distance from the waist opening to the neck opening, and a plurality of pack compartments integrally attached into said back piece and said breast flaps, the improvement comprising:

a seat protector of water repellent fabric attached to the bottom of said back piece of sufficient length and width to cover the area behind the backside of a seated user when in an extended position;

a means to stow said protector to the pack vest when said protector is not in the extended position; and waist encircling belt means interengaging said back piece and each of said breast flaps whereby (a) all pack compartment loads are constrained close to the wearer's body, (b) a portion of the weight of a rear pack compartment load is transferred directly to the wearer's waist and hip region, (c) said breast flaps are prevented from creeping upward under the load weighted influence of said rear pack compartment, and (d) said garment is secured from shifting when loaded.

12. A pack vest as described in claim 11 wherein said means to stow comprises:

a lower compartment integrally formed along the bottom of the back piece of sufficient size to contain the backside protector when not in the extended position with an aperture through which the backside protector can extend;

a closure means for said aperture.

* * * * *